US006192983B1

(12) United States Patent
Neuroth et al.

(10) Patent No.: US 6,192,983 B1
(45) Date of Patent: Feb. 27, 2001

(54) COILED TUBING STRINGS AND INSTALLATION METHODS

(75) Inventors: David H. Neuroth; Earl B. Brookbank, both of Claremore, OK (US); Eugene D. Bespalov; Tim Jackson, both of Aberdeen (GB); Paulo S. Tubel, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/321,929

(22) Filed: May 28, 1999

Related U.S. Application Data

(63) Continuation-in-part of application No. 09/063,771, filed on Apr. 21, 1998, now Pat. No. 6,082,454

(60) Provisional application No. 60/087,327, filed on May 29, 1998.

(51) Int. Cl.[7] ..... E21B 47/00

(52) U.S. Cl. ..... 166/250.15; 166/77.1; 166/77.2

(58) Field of Search ..... 166/250.07, 250.15, 166/250.17, 77.2, 77.1, 77.3

(56) References Cited

U.S. PATENT DOCUMENTS

| | | | | |
|---|---|---|---|---|
| 1,656,215 | | 1/1928 | McDonald et al. . | |
| 4,336,415 | | 6/1982 | Walling . | |
| 4,374,530 | | 2/1983 | Walling . | |
| 4,476,923 | | 10/1984 | Walling . | |
| 4,570,705 | | 2/1986 | Walling . | |
| 4,749,341 | | 6/1988 | Bayh, III . | |
| 5,070,940 | | 12/1991 | Conner et al. . | |
| 5,145,007 | | 9/1992 | Dinkins . | |
| 5,303,592 | * | 4/1994 | Livingston | 73/622 |
| 5,350,018 | | 9/1994 | Sorem et al. . | |
| 5,413,170 | | 5/1995 | Moore . | |
| 5,467,825 | * | 11/1995 | Vallet | 166/379 |
| 5,542,472 | | 8/1996 | Pringle et al. . | |
| 5,544,706 | * | 8/1996 | Reed | 166/379 |
| 5,651,664 | * | 7/1997 | Hinds et al. | 166/105.6 X |
| 5,727,631 | * | 3/1998 | Baker et al. | 166/379 |
| 6,050,340 | * | 4/2000 | Scott | 166/373 |

FOREIGN PATENT DOCUMENTS 2 283 517 5/1995 (GB) .

OTHER PUBLICATIONS

Saz–Jaworsky, "Coiled Tubing . . . . Operations and Services," World Oil, No. 22, (Nov. 1991).

* cited by examiner

*Primary Examiner*—Frank Tsay
(74) *Attorney, Agent, or Firm*—Madan, Mossman & Sriram, P.C.

(57) ABSTRACT

This invention provides oilfield spooled coiled tubing production and completion strings assembled at the surface to include sensors and one or more controlled devices which can be tested from a remote location. The devices may have upsets in the coiled tubing. The strings preferably include conductors and hydraulic lines in the coiled tubing. The conductors provide power and data communication between the sensors, devices and surface instrumentation. The coiled tubing strings are preferably tested at the assembly site and transported to the well site one reels. The coiled tubing strings are inserted and retrieved from the wellbores utilizing an adjustable opening injector head system. This invention also provides method of making electro-coiled-tubing wherein upper and lower adapters are connected to the coiled tubing and tested prior to transporting the string to the wellbore. The string preferably includes pressure barriers at both ends of the string. The string also includes a power line, hydraulic lines, data and communication lines and the desired sensors and devices for use with an electrical submersible pump.

17 Claims, 6 Drawing Sheets

COILED TUBING STRINGS AND INSTALLATION METHODS

CROSS-REFERENCE TO RELATED APPLICATIONS

This application is a continuation-in-part of U.S. application Ser. No. 09/063,771 filed on Apr. 21, 1998, Now U.S. Pat. No. 6,082,454, and further takes priority from U.S. application Ser. No. 60/087,327 filed on May 29, 1998.

BACKGROUND OF THE INVENTION

1. Field of the Invention

This invention relates generally to completion and production strings and more particularly to spooled coiled tubing strings having devices and sensors assembled in the string and tested at the surface prior to their deployment in the wellbores.

2. Background of the Art

To obtain hydrocarbons from the earth subsurface formations ("reservoirs") wellbores or boreholes are drilled into the reservoir. The wellbore is completed to flow the hydrocarbons from the reservoirs to the surface through the wellbore. To complete the wellbore, a casing is typically placed in the wellbore. The casing and the wellbore are perforated at desired depths to allow the hydrocarbons to flow from the reservoir to the wellbore. Devices such as sliding sleeves, packers, anchors, fluid flow control devices and a variety of sensors are installed in or on the casing. Such wellbores are referred to as the "cased holes." For the purpose of this invention, the casing with the associated devices is referred to as the completion string. Additional tubings, flow control devices and sensors are sometimes installed in the casing to control the fluid flow to the surface. Such tubings along with the associated devices are referred to as the "production strings". An electric submersible pump (ESP) is installed in the wellbore to aid the lifting of the hydrocarbons to the surface when the downhole pressure is not sufficient to provide lift to the fluid. Alternatively, the well, at least partially, may be completed without the casing by installing the desired devices and sensors in the uncased or open hole. Such completions are referred to as the "open hole" completions. A string may also be configured to perform the functions of both the completion string and the production string.

Coiled tubing is often used as the tubing for the completion and/or production strings. The coiled tubing is transported to the well site on spools or reels and the devices that cause upsets in the tubing are integrated into the coiled tubing at the well site as it is deployed into the wellbore. Spooled coiled tubing strings with integrated devices have been proposed. Such strings can be assembled at the factory and deployed in the wellbore without additional assembly at the well site. However, the prior art proposed spooled coiled tubing strings require that there be no "upsets" of the outer diameter of the coiled tubing, i.e., the devices integrated into the coiled tubing must be placed inside the coiled tubing or that their outer surfaces be flush with the outer diameter of the coiled tubing. Such limitations have been considered necessary by the prior art because coiled tubings are inserted and retrieved from the wellbores by injector heads, which are typically designed to handle coiled tubings of uniform outer dimensions. In many oilfield applications, it is not feasible or practical to avoid upsets because the gap between the coiled tubing and the borehole wall or the casing may be too large for efficient use of certain devices such as packers and anchors or because of other design and safety considerations. Also, limiting the outer diameter of the devices to the coiled tubing diameter will require designing new devices.

Additionally, the prior art coiled tubing strings do not include sensors required for determining the operation and health (condition) of the various devices and sensors in the string, or controllers downhole and/or at the surface for operating the downhole devices, for monitoring production from the wellbore and for monitoring the wellbore and reservoir conditions during the life of the wellbore. The prior art spooled coiled tubing strings do not provide mechanisms for testing the devices and sensors from an end of the tubing at the surface before the deployment of the string in the wellbore. Completely assembling the string with desired devices and sensors and having mechanisms to test the operations of the devices and the sensors at the factory prior to the deployment of the string in the wellbore can substantially increase the quality and reliability of the such strings and reduce the deployment and retrieval time.

A specific type of coiled tubing, referred to "electro-coiled-tubing" (ECT), contains high power cable, data communication lines or links and hydraulic lines inside the coiled tubing. An ECT is attached to a downhole electrical submersible pump (ESP) with a lower coiled tubing adapter and to the wellhead with an upper coiled tubing adapter. These adapters are installed on the coiled tubing at the well site, typically at the work area below the tubing injector. The lower adapter is assembled on the ECT immediately after the ESP and related equipment has been prepared and hung off in the well. Commercially available adapters are relatively complex devices. They contain fairly complex electrical penetrators (also sometimes referred to as "feed through") along with associated cable connectors which carry electrical power form the ESP power cable across a pressure transition region into the motor and seal section. During deployment of the ECT in the well, if the ECT is not filled with a fluid, it creates a large differential pressure between the wellbore and the inside of the ECT. The penetrator in the lower adapter isolates the inside of the ECT from the wellbore pressure. The lower adapter also includes passages for hydraulic lines and instrument lines and a shear subassembly that can be broken in case the system gets stuck in the well. Installing a lower adapter on the ECT at the well site is a relatively complex and time consuming process. Sophisticated electronic devices, sensors and fiber optic cables and devices are now being used or have been proposed for use in electro-coiledtubings. It is highly desirable to assemble and fully test such ECTs prior to transporting them to the wellsite.

After attaching the lower adapter, the ECT carrying the ESP and associated equipment is run into the well with the tubing injector to the desired location (depth). The upper coiled tubing adapter is then attached to the ECT. As with the lower adapter, the upper adapter also contains an electrical penetrator, various connectors, hydraulic lines and conductors or wires. The upper adapter is then attached to a tubing hanger which is then lowered into the wellhead equipment to support the ECT in the well. Assembly of the upper adapter also is very complex and time consuming. Completely testing the ECT after installing the upper and lower adapters at the well site is not feasible or possible. Thus, it is desirable to install and test all such devices at the factory, which is a relatively clean environment and is conducive to performing rigorous testing of the assembled systems.

The present invention provides spooled coiled tubing strings which include the desired devices and sensors and wherein the devices may cause upsets in the coiled tubing.

The string is assembled and tested at the factory and transported to the well site on spools and deployed into the wellbore by an injector head system designed to accommodate upsets in the tubing strings. The strings of the present invention may be completion strings, production strings and may be deployed in open or cased holes. This invention also provides methods for installing and testing an ECT at the surface prior to transporting them to the well site. The ESP can be installed at the factory or at the well site.

SUMMARY OF THE INVENTION

This invention provides oilfield coiled tubing production and completion strings (production and/or completion strings) which are assembled at the surface to include sensors and one or more controlled devices that can be tested from a remote end of the string. The devices may cause upsets in the coiled tubing. The strings preferably include data communication, power links and hydraulic lines along the coiled tubing. Conductors in the tubing provide power and data communication between the sensors, devices and surface instrumentation. Assembled coiled tubing strings maybe fully listed and certified at the assembly site and are transported to the well site on reels. The coiled tubing strings are inserted and retrieved from the wellbores utilizing adjustable-opening injector heads. Preferably two injector heads are used to accommodate for the upsets and to move the coiled tubing.

In one embodiment, the string includes at least one flow control device for regulating the flow of the production fluids from the well, a controller associated with the flow control device for controlling the operation of the flow control device and the flow of fluid therethrough, a first set of sensors monitoring downhole production parameters adjacent the flow control device, and a second set of sensors along the coiled tubing and spaced from the flow control device provides measurements relating to wellbore parameters. Some of these sensors may monitor formation parameters such as resistivity, water saturation etc. The sensors may include pressure sensors, temperature sensors, vibration sensors, accelerometers, sensors for determining the fluid constituents, sensors for monitoring operating conditions of downhole devices and formation evaluation sensors. A controller receives the information from the sensors and in response thereto and other parameters or instructions provides control signals to the control device. The controller is preferably located at least in part downhole. The sensors may be of any type including fiber optic sensors. The communication link may be a conventional bus or fiber optic link extending from the surface to the devices and sensors in the string. A hydraulic line run along the coiled tubing may be used to activate hydraulically-operated devices.

In an alternative embodiment, the coiled tubing string is a completion string that includes sensors and a controlled device which is available for testing from the remote end of the string before deployment of the string in the wellbore. A flow control device on the coiled tubing regulates the produced fluids from the well. A controller associated with the flow control device controls the operation of the device and the flow of fluid therethrough. A first set of sensors monitors the downhole production parameters adjacent the flow control device. The surface-operated devices in the string are activated or set after the deployment of the string in the wellbore.

This invention also provides a method of making an electro-coiled-tubing ("ECT") carrying a high power line. A lower adapter having a pressure penetrator or barrier is attached to the lower end of the coiled tubing. Any required sensors, hydraulic lines, power lines and data lines are included in the coiled tubing prior to attaching the lower adapter. An upper adapter is attached to the upper end of the coiled tubing. A tubing hanger and an electrical connector are attached uphole of the upper adapter. A second pressure penetrator is included in the upper adapter or at a suitable place proximate the upper end of the coiled tubing. This provides a coiled tubing string wherein the upper and lower pressure penetrators are installed at the factory and fully tested prior to transportation of the ECT to the well site. The upper and lower pressure penetrators provide effective pressure barriers at both ends of the string. The string can then be inserted into the wellbore without taking extra safety measures with respect to pressure differential between the wellbore and the coiled tubing inside. The ESP and associated equipment or any other desired equipment may be assembled at the factory or at the well site.

BRIEF DESCRIPTION OF THE DRAWINGS

For understanding of the present invention, reference should be made to the following detailed description of the preferred embodiment, taken in conjunction with the accompanying drawings, in which like elements have been given like numerals, wherein.

DETAILED DESCRIPTION OF PREFERRED EMBODIMENTS

Figure 1:
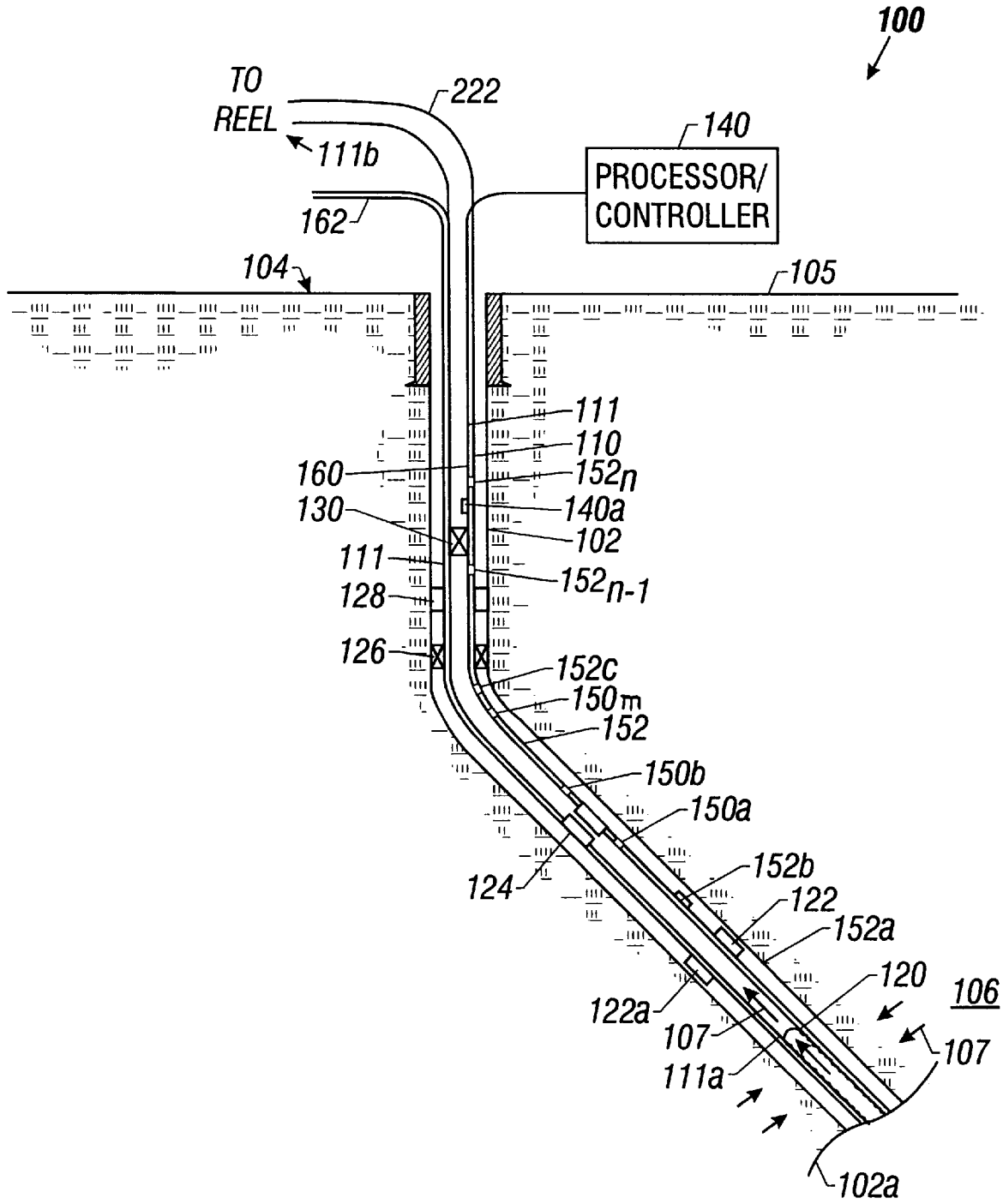
FIG. 1 is a schematic illustration of an exemplary coiled tubing string made according to the present invention and deployed in a wellbore.

FIG. 1 is a schematic illustration of an exemplary wellbore system 100 wherein a coiled tubing completion string 110 made according to one embodiment of the present invention is deployed in an open hole 102. For simplicity and for ease of explanation, the term wellbore or borehole used herein refers to either the open hole or cased hole. The string 110 is assembled at the factory and transported to the well site 104 by conventional methods. After the wellbore 102 has been drilled to a desired depth, the string 110 is inserted or deployed in the wellbore 102 by any suitable method. A preferred injector head system for the deployment and retrieval of the spooled coiled tubing strings of the present invention is described below with reference to FIG. 3. The various desired devices and sensors in the string 110 are placed or integrated into the string 110 at predetermined locations so that when the string 110 is deployed in the wellbore 102, the devices and sensors in the string 110 will be located at their desired depths in the wellbore 102.

In the example of FIG. 1, the string 110 includes a coiled tubing 111 having at its bottom end 111*a* a flow control device 120 that allows the formation fluid 107 from the production zone or reservoir 106 to flow into the tubing 111. The flow control device 120 may be a screen, an instrumented screen, an electrically-operated and/or remotely controlled slotted sleeve or any other suitable device. An internal fluid flow control valve 124 in the coiled tubing 111 controls the fluid flow through the tubing 111 to the surface 105. One or more packers, such as packers 122 and 126, are installed at appropriate locations in the string 110. For the purposes of illustration, the packer 122 is shown in its initial or unextended position while the packer 126 is shown in its fully extended or deployed position in the wellbore 102. The packers 122 and 126 may be flush with the coiled tubing 111 or on the outside of the coiled tubing 111 that causes upsets in the tubing. An annular safety valve 128 is provided on the tubing 111 to prevent blow outs. Other desired devices, generally referred herein by numeral 130 may be located in the string 110 at desired locations. The packers 122 and 126, annular safety valve 128 and any of the devices 130 may cause upsets in the coiled tubing 111 as shown at 122*a* for the packer 122. The outer dimension 122*a* of the packer 122 is greater than the diameter of the coiled tubing 111. It should be noted that spooled strings of the present invention are not limited to the devices described herein. Any suitable device or sensor may be utilized in such strings. Such other devices may include, without limitation, anchors, control valves, flow diverters, seal assemblies electrically submersible pumps (ESP) and any other spoolable device.

The devices 120, 122, 126 and 130 may be hydraulically-operated, electrically-operated, electrically-actuated and hydraulically operated, or mechanically operated. For example, as noted above, the flow restriction device 120 may be a remotely-controlled electrically-operated device wherein fluid flow from the formation 107 to the wellbore 102 can be adjusted from the surface or by a downhole controller. The screen 120 may be instrumented to operate in any other manner. The packers 122 and 126 may be hydraulically-operated and may be set by the supply of fluid under pressure from the surface 105 or activated from the surface and set by the hydrostatic pressure of the wellbore 102. the devices 130 may also include solenoidcontrolled devices to regulate or modulate the fluid flow through the string 110.

Still referring to FIG. 1, sensors 150*a*–150*m* in the string 110 monitor the downhole production parameters adjacent the flow control device 124. These sensors include flow rate sensors or flow meters, pressure sensors, and temperature sensors. Sensors 152*a*–152*n* placed at suitable locations along the coiled tubing 111 are used to determine the operating conditions of downhole devices, monitor conditions or health of downhole devices, monitor production parameters, determine formation parameters and obtain information to determine the condition of the reservoir, perform reservoir modeling, update seismic graphs and monitor remedial or workover operations. Such sensors may include pressure sensors, temperature sensors, vibration sensors and accelerometers. At least some of these sensors may monitor formation parameters or parameters present outside the borehole 102 such as the resistivity of the formation, porosity, permeability, rock matrix composition, density, bed boundaries etc. Sensors for determining the water content and other constituents of the formation fluid may also be used. Such sensors are known in the art and are thus not described in detail. Also, the present invention is particularly suitable for the use of fiber optic sensors distributed along the string 110. Fiber optic sensors are small in size and can be configured to provide measurements that include pressure, temperature, vibration and flow.

A processor or controller 140 at the surface 105 communicates with the downhole devices such as 124 and 130 and sensors 150*a*–150*m* and 152*a*–152*n* via a two-way communication link 160. As an alternative or in addition to the processor 140, a processor 140*a* may be deployed downhole to process signals from the various sensors and to control the devices in the string 110. The communication link 160 may be installed along the inside or outside of the coiled tubing 111. The communication link 160 may contain one or more conductors and/or fiber optic links. Alternatively, a wireless communication link, such as electromagnetic telemetry or acoustic telemetry may be utilized with the appropriate transmitters and receivers located in the string 110 and/or at the surface 105. A hydraulic line 162 is preferably run along the tubing 111 for supplying fluid under pressure from a surface source to hydraulically-operated devices. The communication link 160 and the hydraulic line 162 are accessible at the coiled tubing remote end 111*b* at the surface, which allows testing of the devices 124 and sensors 150*a*–150*m* and 152*a*–152*n* at the surface prior to transporting the string 110 to the well site and then operating such devices after the deployment of the string 110 in wellbore 102. After the string 110 has been installed in the wellbore 102, the hydraulically-operated downhole devices are activated by supplying fluid under pressure from a source at the surface (not shown) via the hydraulic line 162. Electrically-operated devices are controlled vial the link 160.

The information or signals from the various sensors 150*a*–150*m* and 152*a*–152*n* are received by the controller 140 and/or 140*a*. The controller 140 and/or 140*a* which include programs or models and associated memory and data storage devices (not shown), manipulates or processes data from the sensors 150*a*–150*m* and 150*a*–150*n* and provides control signals to the downhole devices such as the flow control device 124, thereby controlling the operation of such devices. The controls may be accomplished via conventional methods or fiber optics. The controllers 140 and/or 140*a* also process downhole data during the life of the wellbore. As noted above, data from the pressure sensors, temperature sensors and vibration sensors may also be utilized for secondary recovery operations, such as fracturing, steam injection, wellbore cleaning, reservoir monitoring, etc. Accelerometers or vibration sensors may be used to perform seismic surveys which are then used to update existing seismic maps.

It should be obvious that FIG. 1 is only an example of the coiled tubing string with exemplary devices. Any spoolable device may be used in the string 110. Such devices may also include safety valves, gas lift devices landing nipples, packer, anchors, pump out plugs, sleeves, electrical submersible pumps (ESP's), robotics devices, etc. The specific devices and sensors utilized will depend upon the particular application. It should also be noted that the spooled coiled tubing string 110 may be designed for both open holes and cased holes.

Figure 2:
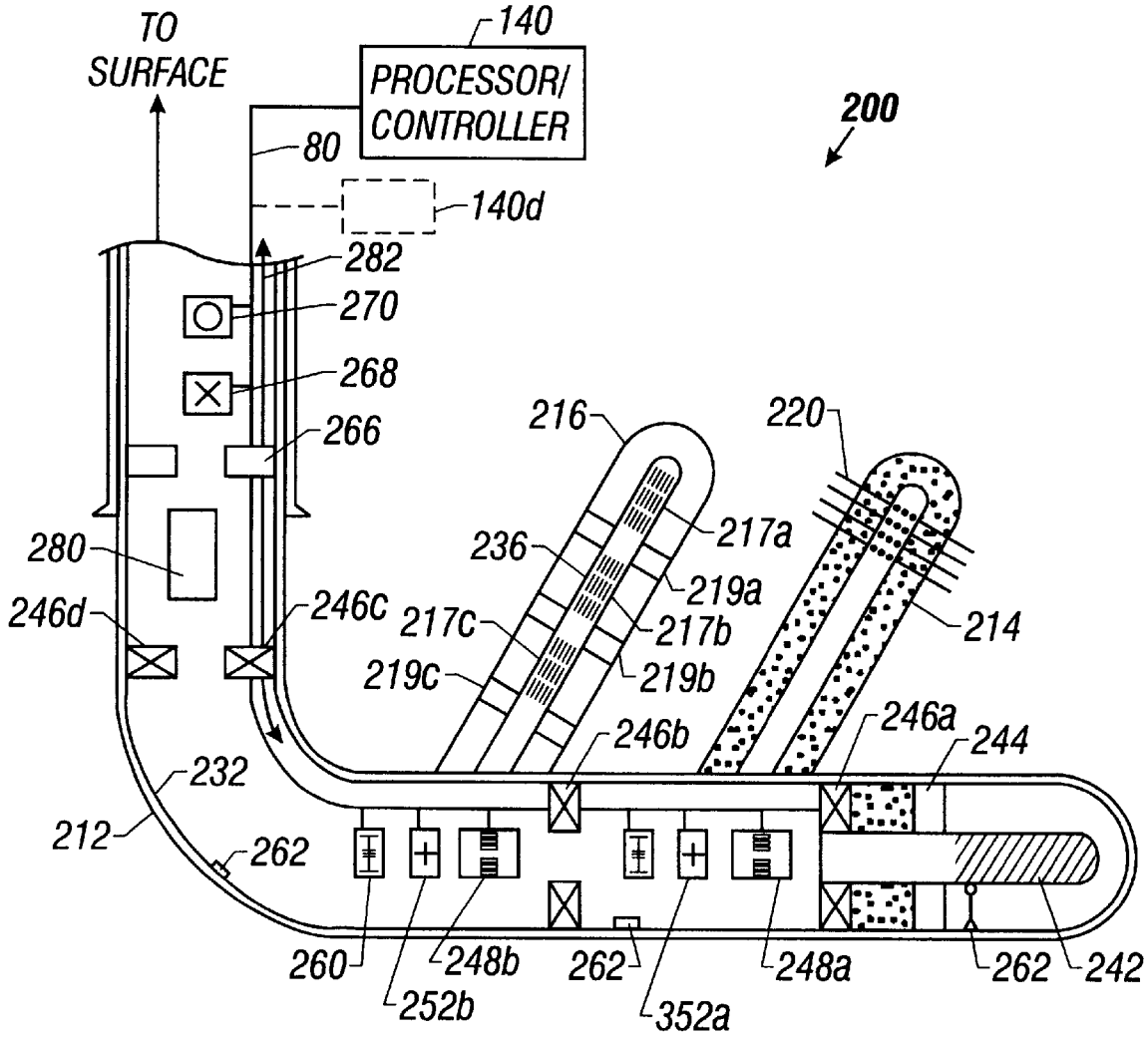
FIG. 2 is a schematic illustration of a spoolable coiled tubing production string placed in a wellbore.

FIG. 2 shows an example of spooled production coiled tubing strings installed in a multilateral wellbore system 200. The system 200 includes a main wellbore 212 and lateral wellbores 214 and 216. The lateral wellbore 214 has a perforated zone 220 that allows the formation fluid to flow into the lateral wellbore 214 and into the main wellbore 212. The lateral wellbore 216 has installed a coiled tubing string 236 that contains slotted liners 217*a*–217*c* and external casing packers (ECP's) 219*a*–219*c*. The packers 219*a*–219*c* are activated from the surface after the string 236 has been placed in the wellbore 216 in the manner described above with reference to FIG. 1. The formation fluid enters the lateral wellbore 216 via the liners 217*a*–217*c* and flows into the main wellbore 212.

A spoolable coiled tubing production string 232 installed in the main wellbore includes an inflow control device 242, which may be wire-wrapped device, a slotted liner, a downhole or remotely-operated sliding sleeve, an instrumented screen or any other suitable device. A packer 244 isolates the production zone from the remaining string 232. Isolation packers 246*a*14 246*c* are placed spaced apart at suitable locations on coiled tubing string 232. The packers 246*a*–246*c* may be hydraulically-operated, either by the supply of the pressurized fluid from the surface, as described above or by the hydrostatic pressure that is activated in any manner known in the art. Flow control device 248*a* controls the fluid flow from the inflow control device 242 into the main wellbore while the device 248*b* controls the flow to the surface. Additional flow control devices may be installed in the string 232 or in the lateral wellbores. Flow meters 252*a* and 252*b* provide the flow rate at their respective locations in the tubing 232. Pressure and temperature sensors 260 are preferably distributively located in the tubing 232. Additional sensors, commonly referred herein by numeral 262 are installed to provide information about parameters outside the wellbore 212. Such parameters may include resistivity of the formation, contents and composition of the formation fluids, etc. Other devices, such as annular safety valves 266, swab valves 268 and tubing mounted safety valves 270 are installed in the tubing 232. Other devices, generally denoted herein by numeral 280 may be installed at suitable locations in the string. Such devices may include an electrical submersible pump (ESP) for lifting fluids to the surface 105 and other devices deemed useful for the efficient operation of the well and/or for the management of the reservoir.

A conduit 282 is used to provide hydraulic fluid to the downhole devices and to run conductors along the tubing 232. Separate conduits or arrangements may be utilized for the supply of the pressurized fluid from the surface and to run communication and power links. A processor/controller 140 at the surface preferably controls the operation of the downhole devices and utilized the information from the various sensors described above. One or more control units or processors may also be placed at a suitable locations in the coiled tubing string 232 to perform some or all of the functions of the processor/controller 140.

Figure 3:
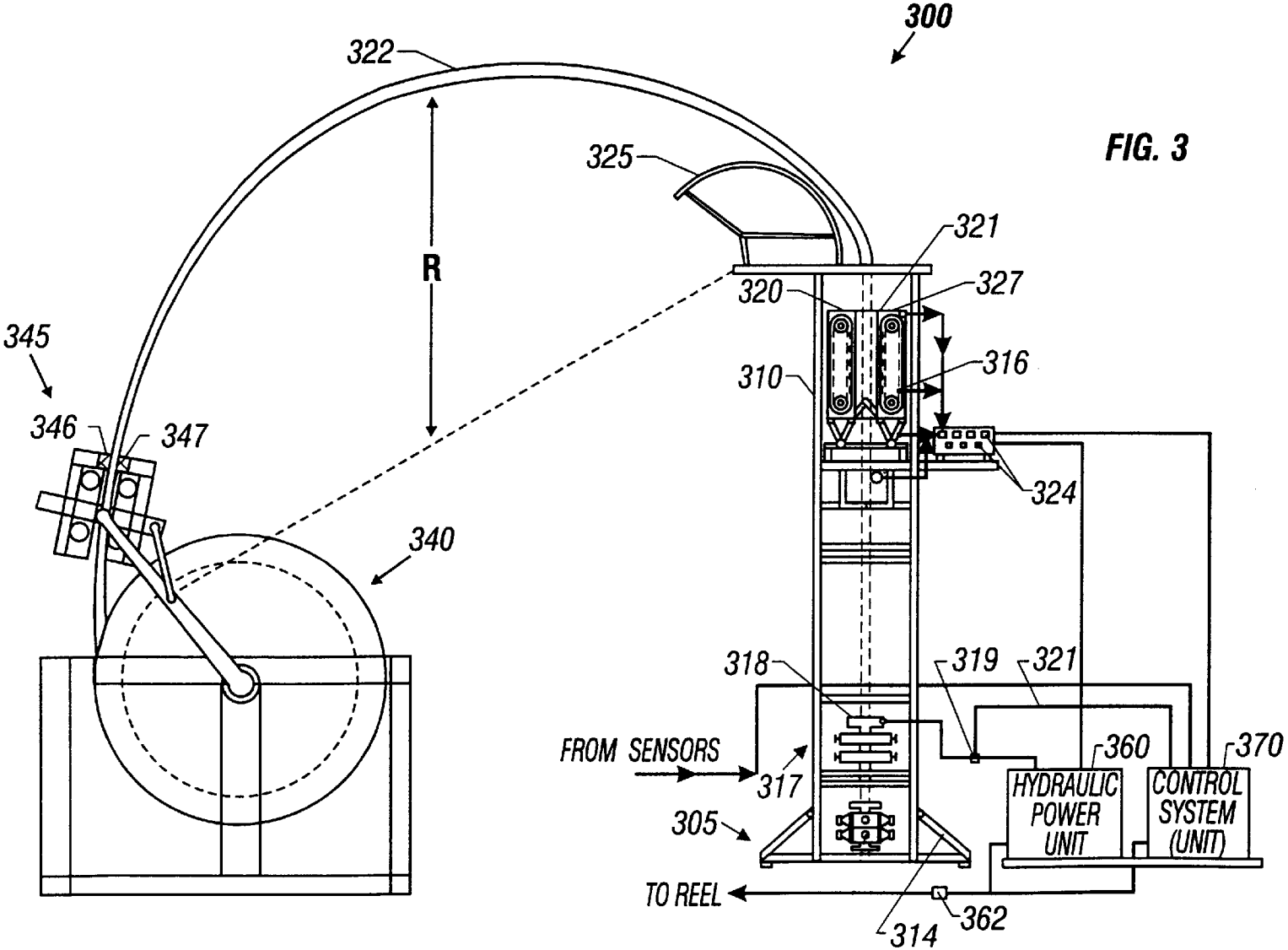
FIG. 3 is a schematic diagram of the spooled coiled tubing string being deployed into a wellbore with two variable width injector heads according to one embodiment of the present invention.

FIG. 3 is a schematic diagram showing the deployment of a spooled coiled tubing string 322 made according to the present invention into a wellbore utilizing adjustable opening injector heads. The coiled tubing string 322 containing the desired devices and sensors is preferably spooled on a large diameter reel 340 and transported to the rig site or well site 305. The string 322 is moved from the reel 340 to the rig 310 by a first injector 345 which is preferably installed near or on the reel 340. A second injector 320 is placed on the rig 310 above the wellhead equipment generally denoted herein by numeral 317. The tubing 322 passes over a gooseneck 325 and into the wellbore via an opening 321 of the injector head 320. The reel injector 345 can maintain an arch of radius R of the tubing 322 that is sufficient to eliminate the use of the tubing guidance member or gooseneck 325 during normal operations, which reduces the stress on the tubing 322. The opening 346 of the reel injector 345 and opening 321 of the main injector 320 can be adjusted while these injector heads move the tubing 322 to accommodate for any upsets in the tubing string 322 and to adjust the gripping force applied on the tubing. Thus, with this system it is relatively easy to move the tubing 322 in and out of the wellbore to accommodate for any upsets in the tubing 322.

The injector heads 320 and 345 are preferably hydraulically-operated. A control unit 370 controls electrically-operated valves 324 to control of the pressurized fluid from the hydraulic power unit 360 to the injector heads 320 and 345. Sensors 316, 319, 327, 347, and 362 and other desired sensors appropriately installed in the system of FIG. 3 provide information to the control unit 370 to independently control the width of the openings 321 and 346, the speed of the tubing 322 through each of the injectors 320 and 345 and the force applied by such injectors onto the tubing 322. This allows for independent adjustment of the head openings to accommodate any upsets in the tubing 322 and the movement of the tubing into or out of the wellbore 102 from a remote location without any manual operations at the rig. The two injector heads ensure adequate gripping force on the tubing 322 at all times and make it unnecessary to assemble coiled tubing strings without any upsets.

Figure 4:
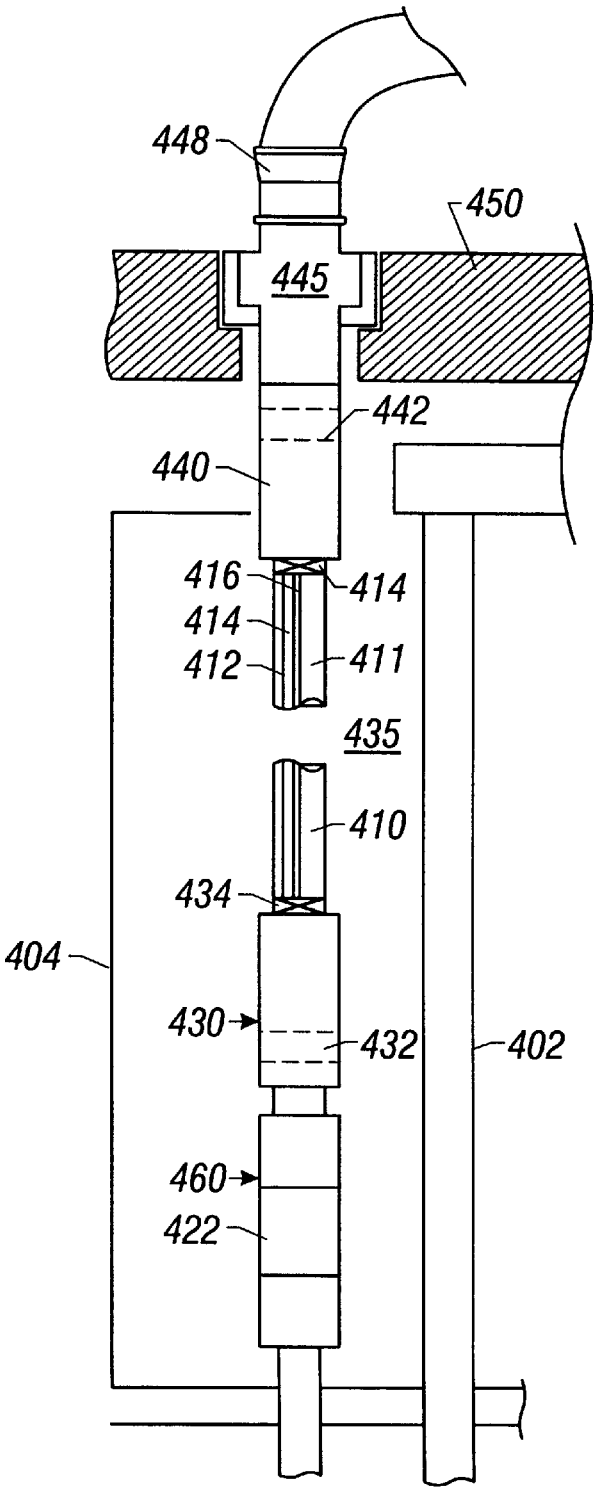
FIG. 4 is a schematic illustration of an ESP and associated equipment deployed in a wellbore with an ECT made according to the present invention.

FIG. 4 is a schematic illustration of an ESP and associated equipment deployed in a wellbore 435 having a casing 402 and a casing liner 404 with an ECT made according to the present invention. The ECT 410 is made according to a known method in the art. It preferably includes a high power cable 412 for carrying power to the ESP 460 and its associated equipment such as a motor 422, one or more hydraulic lines 414 and any other data and power carrying conduits 416, such as wires and fiber optic cables. A lower coiled tubing adapter 430 is assembled on the ECT 410 at the factory or at any suitable place other than at the well site. A suitable adapter is described in detail in reference to FIGS. 5 and 6. The lower adapter includes a pressure penetrator or barrier 432 which isolates the wellbore hydrostatic pressure in the well 435 from the inside 411 of the ECT 410. The adapter described hereafter is installed on the ECT at the point of manufacturing and the assembled ECT is fully tested prior to transportation to the wellsite.

Welding the adapter to the coiled ECT 410 can provide stronger and more reliable connections compared to the presently used methods. Since, in the prior art methods, the adapters are connected at the well site, welding cannot be used due to obvious safety reasons. In the present invention, since the adapter 430 is connected to the ECT 410 at the assembly plant prior to transporting it to the well site, adapter 430 may be welded to the ECT 410 at the connection point 434. The weld 434 is tested by any non-destructive testing method, such as x-ray or pressure test, to ensure the integrity of the weld 434. Welded connections are also much smaller than the conventional slips, elastomer seals etc. Smaller connections offer great advantages in reducing the end complexity of subsea trees 450 and other wellhead equipment. An upper coiled tubing adapter 440 is then connected to the upper end 414 of the ECT 410, by conventional methods or by a weld 444. The upper adapter includes a second pressure or mechanical barrier 442.

Once the ECT 410 has been assembled with the lower adapter 430 and the upper adapter 440, it is preferably fully tested prior to transporting it to the well. The integrity of the adapters can be thoroughly tested with simultaneous access to both ends of the ECT 410. Since no high voltage equipment is attached to the cable up to this point, the high power cable 412 can be high voltage tested at the assembly point without concern for damage to other equipment. The hydraulic lines 414 can be checked end-to-end. Fiber optic lines, conductors and connectors can be fully tested. Calibration procedures are carried out for any sensors (such as temperature sensors, pressure sensors, flow rate sensors, etc.) and other downhole equipment. Calibration of sensors located in the adapters or the ECT cannot be performed in prior art methods because both ends of the ECT are not accessible when the adapters are assembled at the wellsite.

The integrity of the adapters 430 and 440 can be tested by adding halogens to the inside 411 of the ECT 410 with slight pressurization and then detecting any leaks by using a leak detector. A coiled tubing hanger 445 may be connected to the upper adapter 440 at the assembly place or at the well site. An electrical connector 448 is connected uphole of the tubing hanger 448. Thus, in the preferred method of the present invention, the electrical connector 448, the tubing hanger 445, the upper adapter 440 and the lower adapter 430 are preassembled on the ECT 410 at a suitable on shore assembly plant, fully tested, spooled on a reel and then transported to the well site. As noted above, the ESP 420 and the associated equipment 422 may be attached to the lower adapter 430 and fully tested at the assembly plant.

The ECT with the adapters can be pressurized with an inert gas such as argon and fitted with a gauge to monitor the pressure. The pressurized gas not only provides a controlled environment inside the ECT 410 but it also provides method of monitoring the integrity of the system during transportation to the well site and during installation. A rapid pressure drop would indicate damage to the system. Corrective actions are taken before installation or deployment of the system into the well 435.

An important advantage of the ECT assembly with both the upper and lower adapters 440 and 430 in place provides a tested well control barrier with proven pressure holding capability on both ends of the ECT string. This allows the ECT in combination with a stripper or blow out preventor (BOP) to be considered a reliable well control barrier during installation. This is not the case with an ECT that has to be cut and prepared for attachment to the upper and lower adapters above the wellhead as is done by prior art methods. This feature is very useful in offshore and subsea installations where operating procedures requires multiple well control barriers at all times. The ECT string made according to the above described method can be installed at the rig site in less time and with lower safety and environmental risks than the conventional methods described above.

The devices utilized in the coiled tubing strings are flexible enough so that they can be spooled on reels. The strings made according to the present invention are preferably fully assembled at the factory and tested from the remote end (uphole end) of the tubing via the hydraulic lines and communication links in the tubing. The specific devices, sensors and their locations in the string depend upon the particular application. The assembled string may have upsets at its outer surface. The string is transported to the well site and conveyed into the wellbore via an injector head system with remotely adjustable head opening. In addition to the use of various sensors and devices in the spoolable strings of the present invention, it also allows integrating the devices with conventional designs without requiring them being flush with the outer diameter of the tubing.

Figure 5:
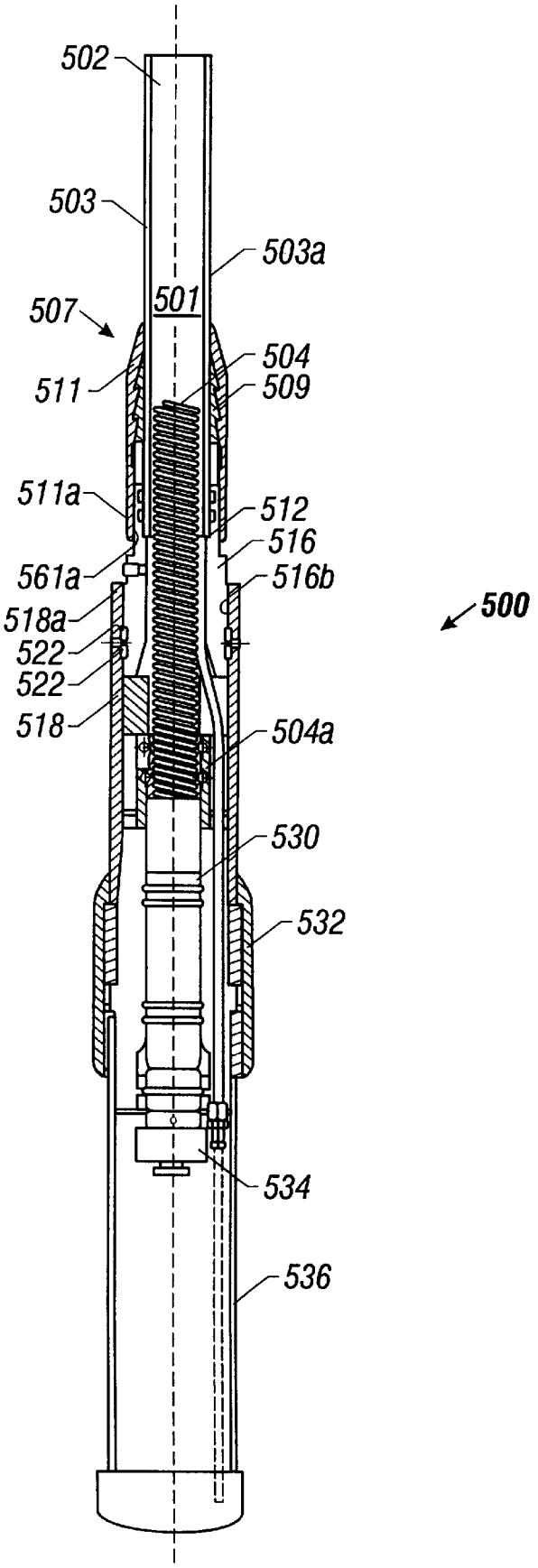
FIG. 5 shows a cross-sectional view of a lower adapter according to one embodiment of the present invention.
Figure 6:
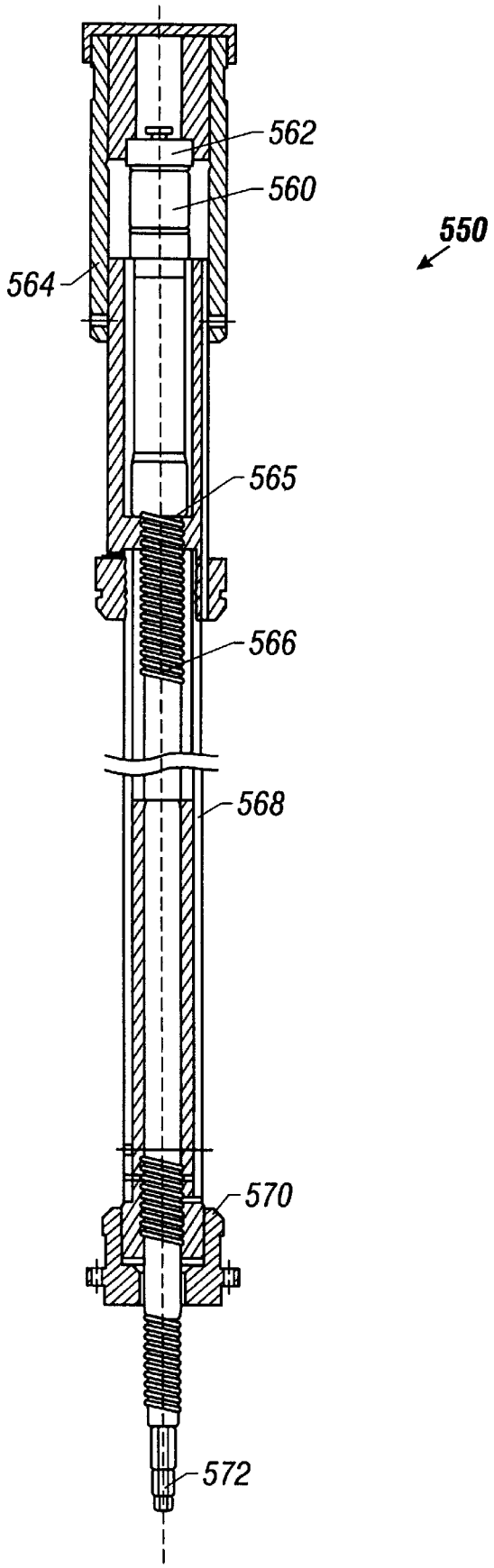
FIG. 6 shows a cross-sectional view of a connector that connects to the lower end of the adapter of FIG. 5 and an ESP.

As noted above, the coiled tubing is assembled onshore with a lower and an upper adapter and fully tested prior to transporting it to the well site. FIG. 5 and 6 show a lower adapter according to one embodiment of the present invention which provides a first mechanical barrier between the wellbore pressure and the coiled tubing inside. FIG. 5 shows a cross-section view of the lower adapter 500 connected to the bottom end of an electro-coiled- tubing (ECT) 502, having the outer metallic or composite tubing 503 and an armored power cable 504 running inside the tubing 503.

The lower adapter 500 includes an anchor 507 fixedly attached to the outer surface 503*a* of the coiled tubing 503. The anchor 507 includes a male slip 509 attached to the tubing surface 503*a* and a female slip 511 connected onto the male slip. The power cable 504 extends from the bottom end 512 of the coiled tubing 503. A hollow member 516 having an outer threaded section 516*a* is screwed into the inner threaded section 511*a* of the female slip 511. The member 516 is disposed around a segment of the power cable 504 and includes an outer threaded section 516*b*. A first or upper sleeve 518 is threadably attached to the member 516 at the threaded upper inside section 518*a* of the sleeve 518. O-rings 522 between the upper sleeve 518 and the member 516 provide a first mechanical barrier between the pressure in the adapter below the O-rings 522 and the coiled tubing inside 501. The seal 522 prevents flow of fluids from the wellbore to the inside 501 of the coiled tubing 502.

The lower end of the power cable 504 terminates inside the upper sleeve 518. An electrical connector 530 is connected to the lower end 504*a* of the power cable 504. The electrical connector 530 is adapted to mate with a connector (described later) attached to the a power cable connected to an ESP or another device to transfer power and other electrical signals from the power cable 504 to the ESP. The electrical connector 530 acts as a hermetically-sealed feed through connector. Such connectors are typically molded parts and are commercially available . The cable 504 terminates inside the connector 530 and seals electrical conductors of the cable 504 from exposure to the environment. A sliding member or sleeve 532 is disposed outside the upper sleeve 518. A shipping cap 536 connected to the sliding sleeve 518 protects the connector 530 during transportation and handling of the coiled tubing 500. The connector 530 is installed at the coiled tubing end onshore or at the factory. This connector enables testing of the coiled tubing 500 at the point of manufacture.

FIG. 6 shows a connector 550 that is adapted for connection with the connector 530 and the ESP. The connector 550 includes a feed through connector 560 whose upper end 562 mates with the lower end 534 of the feed through connector 530 (FIG. 5). A lower sleeve 564, when attached to the sleeve 532, allows the connectors 530 and 560 to mate. The top end 565 of the power cable 566 coupled to an ESP is connected to the connector 560. The power cable 566 is enclosed in a shear assembly 568 that is connected at its bottom end to a flange 570, which is coupled to a corresponding flange (not shown) of the ESP. The bottom end 572 of the power cable 564 is connected to the ESP. The upper adapter 440 (see FIG. 4) is substantially similar to the connector 500 turned upside-down by 180 °.

Thus, the lower or bottom coiled tubing adapter includes a hydraulic disconnect or shear release system, a dry-matable electrical connector, with a sealing assembly isolating inside of the coiled tubing, thus providing a first mechanical barrier to the wellbore environment. The upper or top coiled tubing adapter contains a wet-matable connector and a mechanical arrangement for connection with a tubing crown plug. The second mechanical barrier is part of the connector/plug arrangement.

Thus, one system of the present invention includes a power cable, a coiled tubing, a bottom coiled tubing adapter, and an upper adapter, all assembled and tested onshore prior to installation in a wellbore. This system has several advantages, which include (a) assembly of the major power connectors is performed in a protected environment, such as a manufacturing at the assembly plant followed by extensive testing and certification of the entire system; (ii) welding technology can be used to assemble the coiled tubing system, which is not available at offshore rigs due to safety regulations; (iii) ability to maintain at least two mechanical barriers during installation of the ESP; and (iv) significant simplification of the installation and rig time savings.

The above adapters provide a pre-terminated ECT system which can be utilized both offshore and onshore. This system eliminates the need for connecting the adapters and testing the integrity of the ECT at the rig site before deployment of the ECT into the wellbore, thereby eliminating a number of time consuming operations at the rig site. The ECT described herein is more reliable, easier to use compared to systems that require installation of the adapters in the field or rig site.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A method of making a spoolable coiled tubing string prior to transporting said string to a well site for use in a wellbore, comprising:

providing a coiled tubing of sufficient length to reach a desired depth in the wellbore, said coiled tubing having an upper end and a lower end;

attaching a lower adapter at said lower end of said coiled tubing prior to transporting said coiled tubing string to the well site, said lower adapter including a first pressure barrier between said wellbore and inside of said coiled tubing, said lower adapter also adapted for attachment to a downhole device; and attaching an upper adapter to said upper end of the coiled tubing prior to transporting said coiled tubing string to the well site, said upper adapter adapted for connection to a device at the well head.

2. The method of claim 1 further comprising attaching a tubing hanger to the upper adapter for hanging the coiled tubing string to a wellhead equipment at the wellbore.

3. The method of claim 2 further comprising attaching an electrical connector uphole of the tubing hanger, said electrical connector adapted to mate with an external connector.

4. The method of claim 1 further comprising providing a second pressure penetrator proximate to said upper end of said coiled tubing, said second pressure penetrator providing a pressure barrier between the inside of the coiled tubing and the atmosphere.

5. The method of claim 1 wherein said coiled tubing includes a power cable therethrough for carrying electrical power from said upper end to said lower end.

6. The method of claim 1 wherein said coiled tubing further includes at least one hydraulic line for carrying a pressurized fluid and at least one line for carrying signals.

7. The method of claim 1 further comprising testing said coiled tubing string for defects in said coiled tubing string prior to transporting said string to the well site.

8. The method of claim 1 further comprising filling said coiled tubing with a fluid under pressure for determining leaks during one of transportation and storage of said string.

9. The method of claim 1 wherein the lower adapter is welded to the coiled tubing.

10. The method of claim 9 wherein the upper adapter is welded to the coiled tubing.

11. The method of claim 1 further comprising attaching an electrical submersible pump to the lower adapter for pumping a fluid from the wellbore to the surface.

12. The method of claim 1 wherein said coiled tubing includes at least one sensor for providing signals responsive to at least one downhole parameter.

13. The method of claim 12 wherein said sensor is selected from a group consisting of (i) a pressure sensor, (ii) temperature sensor, (iii) a flow rate sensor, (iv) a vibration sensor, and (v) a corrosion measuring sensor.

14. The method of claim 12, wherein said downhole parameter is selected from a group consisting of (i) pressure, (ii) temperature, (iii) flow rate, (iv) vibration and (v) corrosion.

15. The method of claim 1 wherein said coiled tubing includes a fiber optic line for providing one of (i) a measure of a downhole parameter and (ii) a data communication link.

16. The method of claim 1 further comprising coupling an electrical submersible pump to the lower adapter.

17. The method of claim 16 further comprising inserting the coiled tubing in the wellbore with an adjustable-opening injector head.

* * * * *